US011199189B2

(12) United States Patent
Yamashita et al.

(10) Patent No.: US 11,199,189 B2
(45) Date of Patent: Dec. 14, 2021

(54) CO-ROTATING SCROLL COMPRESSOR AND ASSEMBLY METHOD THEREFOR

(71) Applicant: MITSUBISHI HEAVY INDUSTRIES, LTD., Tokyo (JP)

(72) Inventors: Takuma Yamashita, Tokyo (JP); Takahide Ito, Tokyo (JP); Keita Kitaguchi, Tokyo (JP); Makoto Takeuchi, Tokyo (JP); Hirohumi Hirata, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/966,675

(22) PCT Filed: Nov. 2, 2018

(86) PCT No.: PCT/JP2018/040874
§ 371 (c)(1),
(2) Date: Jul. 31, 2020

(87) PCT Pub. No.: WO2019/150680
PCT Pub. Date: Aug. 8, 2019

(65) Prior Publication Data

US 2021/0033093 A1 Feb. 4, 2021

(30) Foreign Application Priority Data

Feb. 5, 2018 (JP) ..... JP2018-018403

(51) Int. Cl.
*F04C 18/02* (2006.01)
*F04C 23/00* (2006.01)
(Continued)

(52) U.S. Cl.
CPC ..... *F04C 18/0238* (2013.01); *F04C 18/0253* (2013.01); *F04C 23/008* (2013.01);
(Continued)

(58) Field of Classification Search
CPC ..... F04C 18/023–0238; F04C 15/0061–0073; F04C 29/005–0071; F04C 2240/60–605; F01C 1/023–0238
See application file for complete search history.

(56) References Cited

U.S. PATENT DOCUMENTS 2,475,247 A 7/1949 Mikulasek
3,817,664 A * 6/1974 Bennett ..... F01C 1/0215 418/55.1

(Continued)

FOREIGN PATENT DOCUMENTS

| | | |
|---|---|---|
| JP | 62-93401 | 4/1987 |
| JP | 5443132 | 3/2014 |
| WO | 2019/039575 | 2/2019 |

OTHER PUBLICATIONS

International Search Report dated Dec. 11, 2018 in International (PCT) Application No. PCT/JP2018/040874, with English translation.

(Continued)

*Primary Examiner* — Laert Dounis
(74) *Attorney, Agent, or Firm* — Wenderoth, Lind & Ponack, L.L.P.

(57) ABSTRACT

Provided is a co-rotating scroll compressor comprising a synchronous drive mechanism that can achieve a long life. The compressor comprises a driving side scroll member (90) driven to rotate about a driving side rotation axis CL1, a driven side scroll member (70) driven to rotate about a driven side rotation axis CL2, a hollowed drive shaft (6) that is connected to the driving side scroll member (90), and driven by a motor (5) to rotate, and a driven shaft (20) that is disposed inside the drive shaft (6), and has one end connected to the drive shaft (6) via a first flexible coupling
(Continued)

(21) and the other end connected to the driven side scroll member (70) via a second flexible coupling (22).

6 Claims, 6 Drawing Sheets

(51) Int. Cl.
*F04C 29/00* (2006.01)
*F04C 29/02* (2006.01)

(52) U.S. Cl.
CPC ..... *F04C 18/0215* (2013.01); *F04C 29/0057* (2013.01); *F04C 29/023* (2013.01); *F04C 2240/30* (2013.01); *F04C 2240/603* (2013.01)

(56) References Cited

U.S. PATENT DOCUMENTS

| | | | |
|---|---|---|---|
| 4,610,611 | A | 9/1986 | Blain |
| 2020/0088193 | A1 | 3/2020 | Yamashita et al. |

OTHER PUBLICATIONS

Written Opinion of the International Searching Authority dated Dec. 11, 2018 in International (PCT) Application No. PCT/JP2018/040874, with English translation.

* cited by examiner

CO-ROTATING SCROLL COMPRESSOR AND ASSEMBLY METHOD THEREFOR

TECHNICAL FIELD

The present invention relates to a co-rotating scroll compressor and an assembly method therefor.

BACKGROUND ART

Heretofore, a co-rotating scroll compressor has been known (see Patent Literature 1). This compressor comprises a driving side scroll, and a driven side scroll that rotates synchronously with the driving side scroll, and a driven shaft that supports the rotation of the driven side scroll is offset as much as a revolving radius to a drive shaft that rotates the driving side scroll, to rotate the drive shaft and the driven shaft at the same angular velocity in the same direction.

CITATION LIST

Patent Literature

[PTL 1]
the Publication of Japanese Patent No. 5443132

SUMMARY OF INVENTION

Technical Problem

In a co-rotating scroll compressor, a synchronous drive mechanism is used to transmit a driving force from a driving side scroll member to a driven side scroll member to perform rotation movement of the driving side scroll member and the driven side scroll member at the same angular velocity in the same direction. A possible synchronous drive mechanism includes a crank pin mechanism, a pin ring mechanism, and a pin-pin mechanism (a mechanism where two pins are used), each of these mechanisms comprising a rolling bearing. If a lubricant enclosed in the rolling bearing leaks, there is concern that the lubricant is mixed in and contaminates a compression medium such as air.

Furthermore, in the synchronous drive mechanism where a bearing is used, the synchronous drive mechanism has a life determined by a wear-dominated bearing life, resulting in a finite life design. Consequently, the synchronous drive mechanism that can achieve a long life is desired.

An object of the present invention, which has been developed in view of such situations, is to provide a co-rotating scroll compressor comprising a synchronous drive mechanism that can achieve a long life, and an assembly method for the compressor.

Solution to Problem

A co-rotating scroll compressor according to an aspect of the present invention comprises a driving side scroll member that is driven by a drive unit to rotate about a driving side rotation axis, and includes a spiral driving side wall body disposed on a driving side end plate, a driven side scroll member that is driven to rotate about a driven side rotation axis parallel to the driving side rotation axis, performs rotation movement at the same angular velocity in the same direction as in the driving side scroll member, and includes a spiral driven side wall body corresponding to the driving side wall body and disposed on a driven side end plate, the driven side wall body being caused to mesh with the driving side wall body to form a compression space, a hollowed drive shaft that is connected to the driving side scroll member, and driven by the drive unit to rotate, and a driven shaft that is disposed inside the drive shaft, and has one end connected to the drive shaft via a first flexible coupling and the other end connected to the driven side scroll member via a second flexible coupling.

The driving side wall body disposed or the driving side end plate of the driving side scroll member meshes with the driven side wall body of the driven side scroll member, to form the compression space. The driving side scroll member is driven by the drive unit to rotate about the driving side rotation axis, and the driven side scroll member rotates about the driven side rotation axis, and performs the rotation movement at the same angular velocity in the same direction as in the driving side scroll member. Consequently, provided is the co-rotating scroll compressor in which both the driving side scroll member and the driven side scroll member rotate.

A rotational driving force is transmitted from the drive shaft to the driving side scroll member.

The rotational driving force is transmitted from the driven shaft to the driven side scroll member. The driven shaft has one end connected to the drive shaft via the first flexible coupling, and the other end connected to the driven side scroll member via the second flexible coupling. Consequently, the rotational driving force from the drive shaft is transmitted to the driven side scroll member via the driven shaft. The driven shaft connects the drive shaft to the driven side scroll member via the first flexible coupling and the second flexible coupling, and hence the rotation of the drive shaft that rotates about the driving side rotation axis can be transmitted to the driven side scroll member that rotates about the driven side rotation axis parallel to the driving side rotation axis.

Consequently, by use of the driver, shaft, the first flexible coupling and the second flexible coupling, the rotational driving force of the drive shaft can be transmitted to the driven side scroll member without using any bearings that require a lubricant. Consequently, it is not necessary to use any lubricants in a mechanism that transmits the rotational driving force to the driven side scroll member, and it is possible to prevent contamination of a compression medium.

Furthermore, in a synchronous drive mechanism that transmits the rotational driving force to the driven side scroll member, use of a mechanism such as a rolling bearing having a life determined by friction is avoided, and the driven shaft and the flexible couplings are used, so that an infinite life design determined by a fatigue life of a leaf spring, rubber or the like of each flexible coupling is possible.

Additionally, in place of a configuration where the drive shaft and the driven shaft are arranged in an axial direction and connected in series, the driven shaft is disposed in the hollowed drive shaft, and hence an axial length can be decreased as much as possible.

Furthermore, in the co-rotating scroll compressor according to an aspect of the present invention, the first flexible coupling is disposed on an opposite side of the drive shaft as seen from the driving side scroll member, and the second flexible coupling is disposed on a driving side scroll member side of the drive shaft.

The first flexible coupling that connects the driven shaft to the drive shaft is disposed on the opposite side of the drive shaft as seen from the driving side scroll member, and the second flexible coupling that connects the driven side scroll member to the driven shaft is disposed on the driving side scroll member side of the drive shaft. Thus, the driven shaft is disposed entirely over a longitudinal direction of the drive shaft inside the drive shaft. Consequently, a deflection angle in each flexible coupling can be decreased as much as possible, and a life of the flexible coupling can be prolonged.

Furthermore, in the co-rotating scroll compressor according to an aspect of the present invention, positioning holes in which a common positioning pin is to be inserted are formed in the driving side scroll member and the driven side scroll member.

If assembly is performed by using the first flexible coupling and the second flexible coupling, there is concern that accuracy of phase alignment in a rotation direction decreases. To solve the problem, the positioning holes in which the common positioning pin can be inserted are formed in the driving side scroll member and the driven side scroll member. Thus, the positioning pin is inserted in the positioning holes during the assembly, so that the phase alignment in the rotation direction can be accurately determined.

Note that the positioning pin is removed after the assembly.

Furthermore, the co-rotating scroll compressor according to an aspect of the present invention further comprises a housing that houses the driving side scroll member and the driven side scroll member, wherein an insertion hole in which the common positioning pin is to be inserted is formed in the housing.

The insertion hole in which the common positioning pin can be inserted is provided in the housing, and the positioning pin is inserted from outside the housing, so that the driving side scroll member and the driven side scroll member can be positioned.

Additionally, the co-rotating scroll compressor according to an aspect of the present invention further comprises a sealing member with which the insertion hole is sealed.

The insertion hole formed in the housing is sealed with the sealing member, so that contamination of a compression medium can be prevented. Particularly, this is effective in case where the insertion hole is opened to an exterior of the compressor.

Note that in case where the insertion hole is opened in a motor storage space that is the drive unit, it is preferable that the sealing member is not provided. Consequently, pressure in the motor storage space and pressure in a scroll storage space in which the scroll member is stored are equalized, and it can be avoided that a lubricant of a bearing that supports the rotation of the scroll member leaks to a compression medium side.

Furthermore, according to an aspect of the present invention, provided is an assembly method for a co-rotating scroll compressor comprising: a driving side scroll member that is driven by a drive unit to rotate about a driving side rotation axis, and includes a spiral driving side wall body disposed on a driving side end plate, a driven side scroll member that is driven to rotate about a driven side rotation axis parallel to the driving side rotation axis, performs rotation movement at the same angular velocity in the same direction as in the driving side scroll member, and includes a spiral driven side wall body corresponding to the driving side wall body and disposed on a driven side end plate, the driven side wall body being caused to mesh with the driving side wall body to form a compression space, a hollowed drive shaft that is connected to the driving side scroll member, and driven by the drive unit to rotate, and a driven shaft that is disposed inside the drive shaft, and has one end fixed to the drive shaft via a first flexible coupling and the other end connected to the driven side scroll member via a second flexible coupling, wherein positioning holes in which a common positioning pin is to be inserted are formed in the driving side scroll member and the driven side scroll member, the assembly method for the co-rotating scroll compressor, comprising a step of inserting the common positioning pin in the positioning holes to position the driving side scroll member and the driven side scroll member, and then removing the common positioning pin.

Advantageous Effects of Invention

Use of a mechanism such as a rolling bearing having a life determined by friction in a synchronous drive mechanism that transmits a rotational driving force to a driven scroll is avoided, and a flexible coupling and a driven shaft are used. Consequently, an infinite life design determined by a fatigue life of a leaf spring, rubber or the like of the flexible coupling is possible, and the life can be prolonged.

DESCRIPTION OF EMBODIMENTS

Hereinafter, an embodiment according to the present, invention will be described with reference to the drawings.

Figure 1:
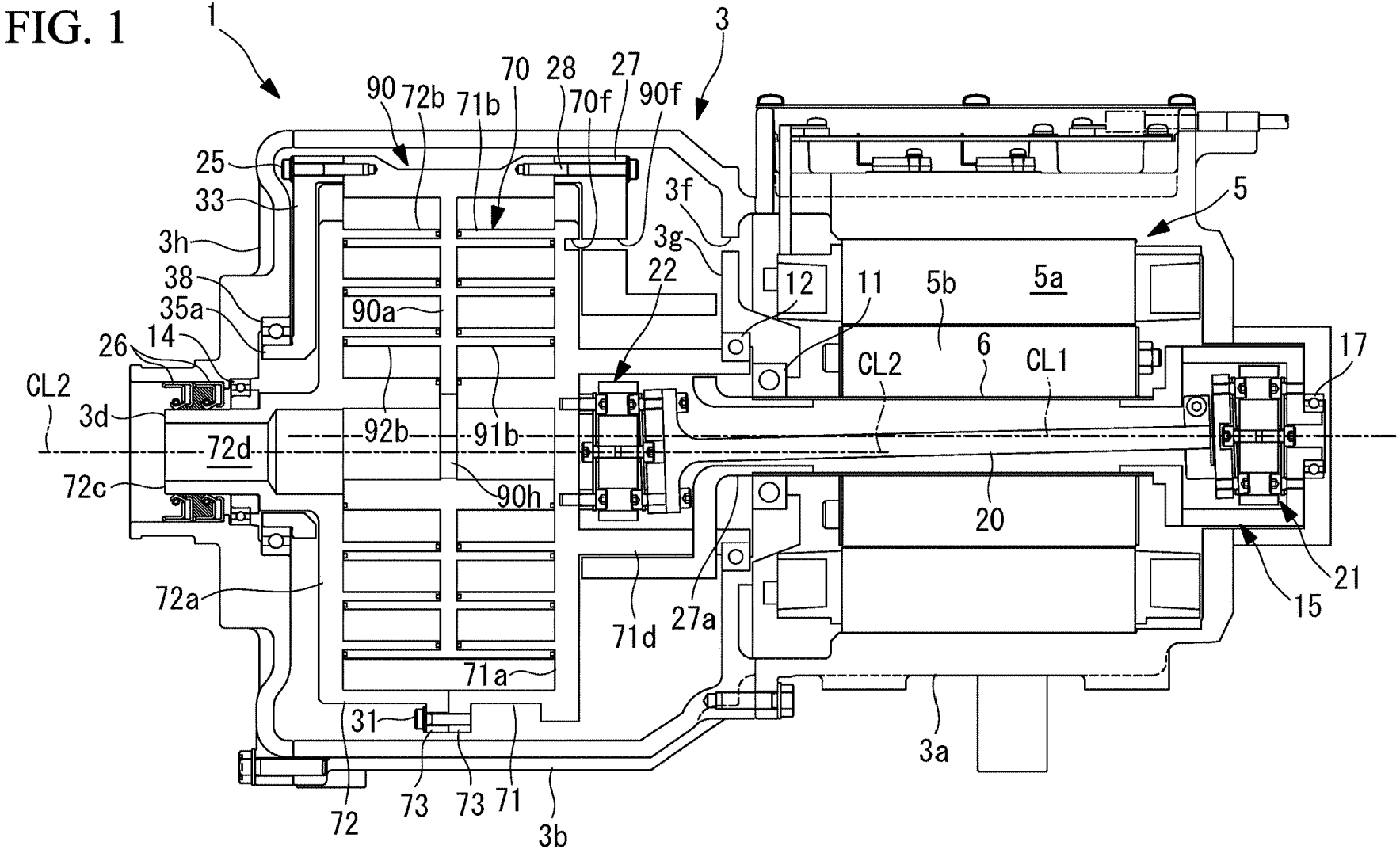
FIG. 1 is a longitudinal cross-sectional view showing a co-rotating scroll compressor according to an embodiment of the present invention.

FIG. 1 shows a co-rotating scroll compressor 1. The co-rotating scroll compressor 1 can be used as a supercharger that compresses combusting air (a fluid) to be supplied to an internal combustion engine such as an engine for a vehicle, a compressor to supply compressed air to an electrode of a fuel cell, or a compressor to supply compressed air for use in a braking device of a vehicle for a railway or the like.

The co-rotating scroll compressor 1 comprises a housing 3, a motor (a drive unit) 5 housed on one end side of the housing 3, and a driven side scroll member 70 and a driving side scroll member 90 housed on the other end side of the housing 3.

The housing 3 is formed in an almost cylindrical shape, and comprises a motor storage section 3*a* that stores the motor 5, and a scroll storage section 3*b* that stores the scroll members 70 and 90.

A discharge port 3*d* to discharge compressed air is formed in an end of the scroll storage section 3*b*. Note that although not shown in FIG. 1, an air intake port to take air into the housing 3 is provided.

The motor 5 is driver, by supplying power from an unshown power supply source. Rotation of the motor 5 is controlled in accordance with an instruction from an unshown control unit. A stator 5*a* of the motor 5 is fixed to an inner peripheral side of the housing 3. A rotor 5*b* of the motor 5 rotates about a driving side rotation axis CL1. A drive shaft 6 extending onto the driving side rotation axis CL1 is fixed to the inner peripheral side of the rotor 5*b*. The drive shaft 6 has a hollowed cylindrical shape. A coupling storage shaft 15 is fixed to a rear end (a right end) of the drive shaft 6, and a drive plate shaft 27*a* provided in a drive plate 27 of the driving side scroll member 90 is fixed to a front end (a left end) of the drive shaft.

A driving side bearing 11 that rotatably supports the drive shaft 6 is provided at the front end of the drive shaft 6. A rear end bearing 17 that rotatably supports the drive shaft to the housing 3 is provided at a rear end of the coupling storage shaft 15.

The driven side scroll member 70 comprises a first driven side scroll 71 on a motor 5 side, and a second driven side scroll 72 on a discharge port 3*d* side.

The first driven side scroll 71 comprises a first driven side end plate 71*a* and a first driven side wall body 71*b*.

The first driven side end plate 71*a* extends in a direction orthogonal to a driven side rotation axis CL2. A first driven side scroll shaft 71*d* extending about the driven side rotation axis CL2 that is a central axis is fixed to the first driven side end plate 71*a*. A tip (a right end) of the first driven side scroll shaft 71*d* is supported to the housing 3 in a rotatable manner by a first driven side bearing 12.

Figure 2:
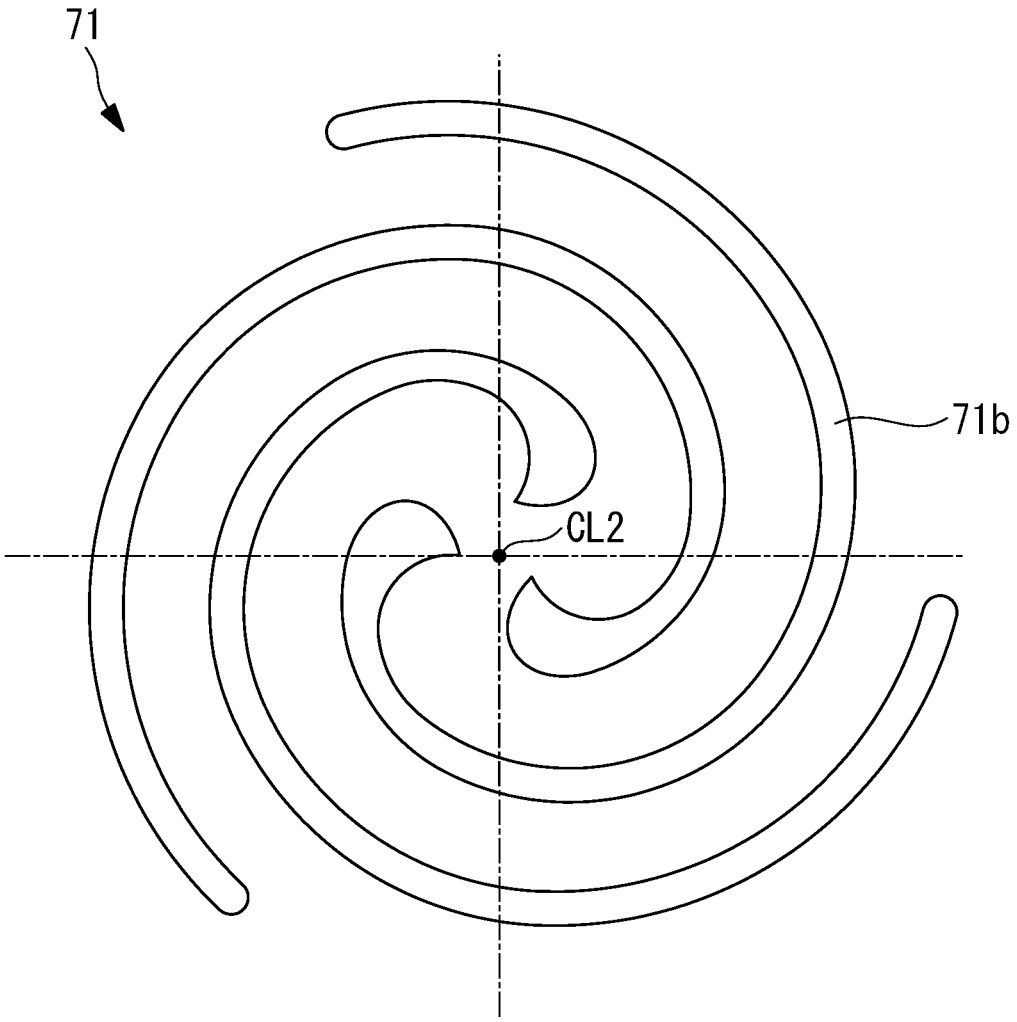
FIG. 2 is a plan view showing a first driving side wall body of FIG. 1.

The first driven side end plate 71*a* has an almost disk shape in plan view. On the first driven side end plate 71*a*, as shown in FIG. 2, three spirally formed first driven side wall bodies 71*b*, i.e., three spirals are provided. The three spirals of the first driven side wall body 71*b* are arranged at an equal interval around the driven side rotation axis CL2. Note that a number of the spirals of the first driven side wall body 71*b* way be one, two, four or more.

As shown in FIG. 1, the second driven side scroll 72 comprises a second driven side end plate 72*a* and a second driven side wail body 72*b*. Three spirals of the second driven side wall body 72*b* are provided in the same manner as in the first driven side wall body 71*b* described above (see FIG. 2). Note that a number of the spirals of the second driven side wall body 72*b* may be one, two, four or more.

A second driven side scroll shaft 72*c* extending in a driven side rotation axis CL2 direction is connected to the second driven side end plate 72*a*. The second driven side scroll shaft 72*c* is provided to the housing 3 in a rotatable manner via a second driven side bearing 14. A discharge port 72*d* is formed along the driven side rotation axis CL2 in the second driven side end plate 72*a*.

Two seal members 26 are provided on a tip side (a left side in FIG. 1) of the second driven side scroll shaft 72*c* from the second driven side bearing 14 between the second driven side scroll shaft 72*c* and the housing 3. The two seal members 26 and the second driven side bearing 14 are arranged at a predetermined interval in the driven side rotation axis CL2 direction. Note that a number of the seal members 26 may be one.

The first driven side scroll 71 and the second driven side scroll 72 are fixed in a state where tips (free ends) of the wall bodies 71*b*, 72*b* are opposite to each other. The first driven side scroll 71 and the second driven side scroll 72 are fixed with bolts 31 fastened to flange parts 73 provided to project outward in a radial direction at a plurality of positions in a circumferential direction.

In the driving side scroll member 90, a driving side end plate 90*a* is located in an almost center in an axial direction (a horizontal direction in the drawing). The driving side end plate 90*a* extends in a direction orthogonal to the driving side rotation axis CL1. A through hole 90*h* is formed in a center of the driving side end plate 90*a*, and the compressed air flows to the discharge port 72*d*.

Driving side wall bodies 91*b*, 92*b* are provided on opposite sides of the driving side end plate 90*a*, respectively. The first driving side wall body 91*b* installed on the motor 5 side of the driving side end plate 90*a* meshes with the first driven side wall body 71*b* of the first driven side scroll 71, and the second driving side wall body 92*b* installed on the discharge port 3*d* side of the driving side end plate 90*a* meshes with the second driven side wall body 72*b* of the second driven side scroll 72.

Figure 3:
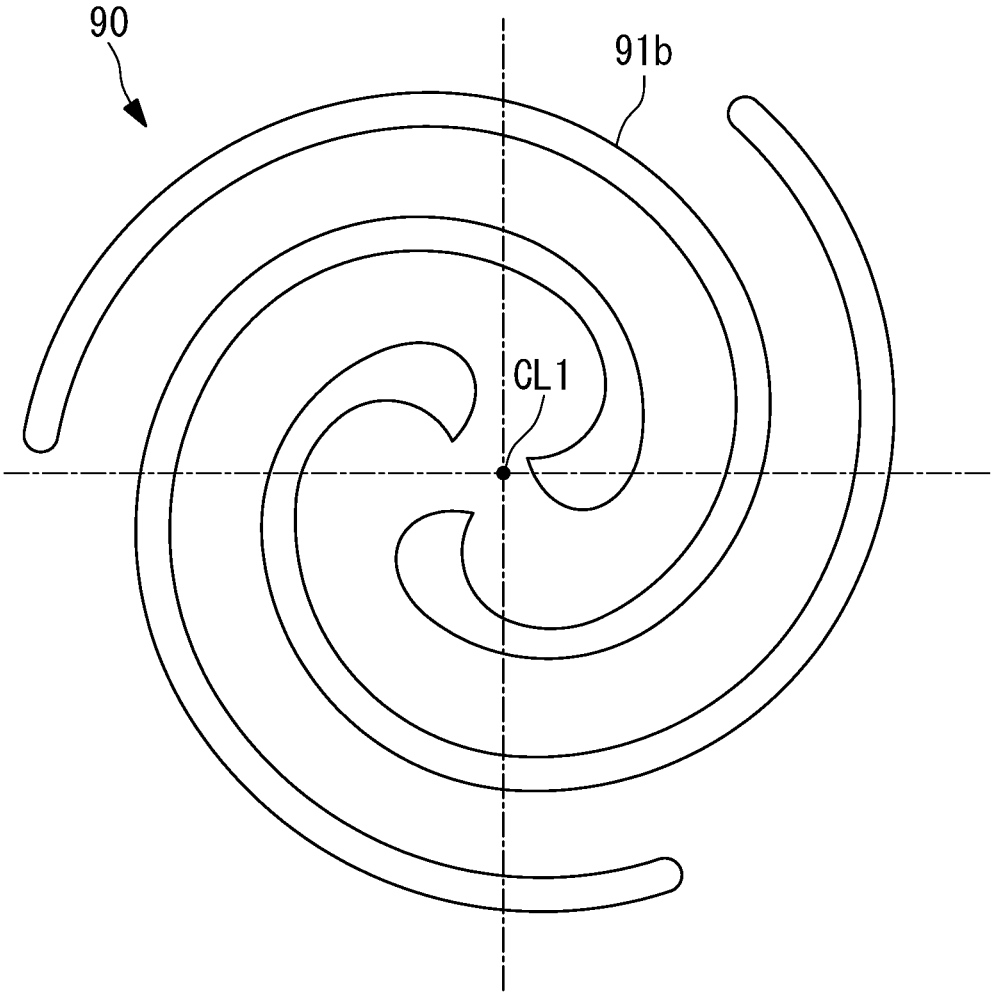
FIG. 3 is a plan view showing a first driven side wall body of FIG. 1.

As shown in FIG. 3, three first driving side wail bodies 91*b*, i.e., three spirals are provided. The three spirals of the driving side wall body 91*b* are arranged at an equal interval around the driving side rotation axis CL1. This configuration also applies to the second driving side wall body 92*b*. Note that a number of the spirals of each of the driving side wall bodies 91*b*, 92*b* may be one, two, four or more.

A support member 33 is provided on the discharge port 3*d* side (the left side in FIG. 1) of the driving side scroll member 90. The support member 33 is fixed to a tip (a free end) of the second driving side wail body 92*b* with a bolt 25.

A shaft 35*a* for the support member is provided on a central axis side of the support member 33, and the support member shaft 35*a* is fixed to the housing 3 via a second support member bearing 38. Consequently, the driving side scroll member 90 rotates about the driving side rotation axis CL1 via the support member 33.

Figure 4:
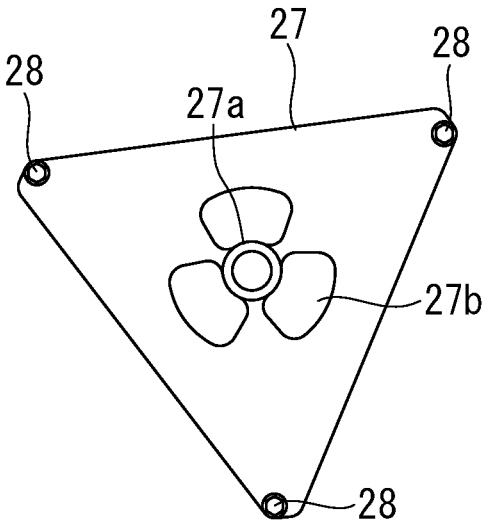
FIG. 4 is a plan view showing a drive plate.
Figure 5:
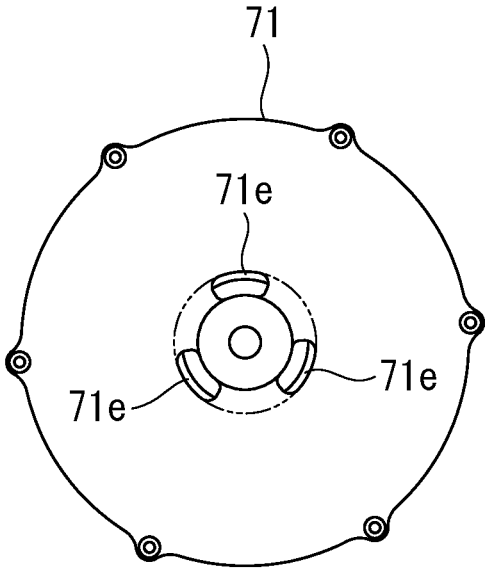
FIG. 5 is a plan view showing a split shaft provided in a driven side scroll member.

The drive plate 27 is provided on the motor 5 side (a right side in FIG. 1) of the driving side scroll member 90. The drive plate 27 is fixed to a tip (a free end) of the first driving side wall body 91*b* with a bolt 28. The drive plate shaft 27*a* provided in the drive plate 27 is formed in a cylindrical shape as shown in FIG. 4. A plurality of (three in the present embodiment) insertion holes 27*b* are formed at an equal interval in the circumferential direction around the drive plate shaft 27*a*. A tip side of the first driven side scroll shaft 71*d* is inserted into each of the insertion holes 27*b*. On the tip side of the first driven side scroll shaft 71*d*, as shown in FIG. 5, a plurality of (three in the present embodiment) split shafts 71*e* split at an equal interval in the circumferential direction are provided.

Figure 6:
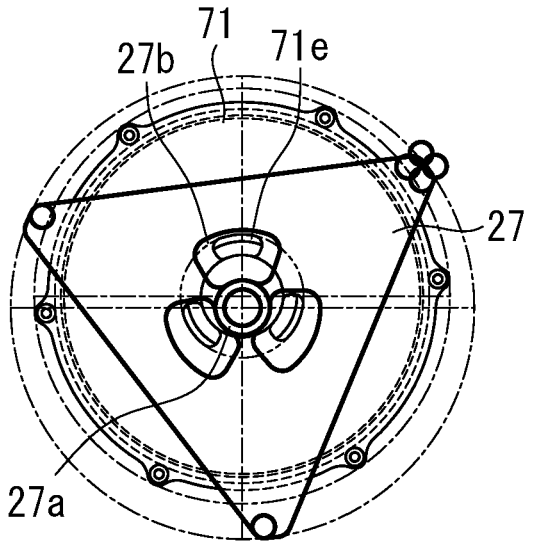
FIG. 6 is a plan view showing a state where the split shaft of FIG. 5 is inserted into an insertion hole of the drive plate of FIG. 4.

FIG. 6 shows a state where the split shafts 71*e* are inserted into the insertion holes 27*b* of the drive plate 27. As seen from the drawing, each of the insertion holes 27*b* is formed to such an extent that each split shaft 71*e* does not interfere with the drive plate 27 in case where the driving side scroll member 90 and the driven side scroll member 70 relatively perform revolving movement.

Synchronous Drive Mechanism

Next, a synchronous drive mechanism will be described with reference to FIG. 1. In the present embodiment, a conventional mechanism that requires a lubricant, such as a pin ring or a crank pin, is not used.

As shown in FIG. 1, a driven shaft 20 is disposed in the hollowed drive shaft 6. A first flexible coupling 21 is connected to a rear end (a right end) of the driven shaft 20, and a second flexible coupling 22 is connected to a front end (a left end) of the driven shaft 20.

The first flexible coupling 21 is a coupling that has a rigidity and transmits a rotational driving force in a rotation direction about an axis, and allows a predetermined amount of eccentricity of the axis. The first flexible coupling 21 is composed, for example, of a plurality of disk-shaped leaf springs spaced away via a predetermined face-to-face distance, transmits the rotational driving force with the rigidity of each leaf, spring in an in-plane direction (a direction along a plane), and allows the eccentricity of the axis by deflection in an out-of-plane (a direction orthogonal to the plane). Note that in case where desired rigidity can be obtained, a rubber may be used in place of the leaf spring.

The rear end (the right end) of the first flexible coupling 21 is fixed to the coupling storage shaft 15. Consequently, the rotational driving force from the drive shaft 6 is transmitted to the first flexible coupling 21. The first flexible coupling 21 is attached so that a central axis thereof coincides with the driving side rotation axis CL1.

The second flexible coupling 22 includes a structure similar to the first flexible coupling 21. A front end (a left end) of the second flexible coupling 22 is fixed to a back surface (the surface opposite to the first driven side wall body 71*b*) of the first driven side end plate 71*a* of the driven side scroll member 70. The second flexible coupling 22 is attached so that a central axis thereof coincides with the driven side rotation axis CL2.

Thus, in the synchronous drive mechanism of the present embodiment, the flexible couplings 21, 22 are provided at opposite ends of the driven shaft 20, so that rotation about the driving side rotation axis CL1 is transmitted as rotation about the driven side rotation axis CL2 that is eccentric.

Positioning

Next, description will be made as to positioning in the rotation direction of the driven side scroll member 70 and the driving side scroll member 90.

As shown in FIG. 1, positioning holes 90*f*, 70*f* are formed in the driving side scroll member 90 and the driven side scroll member 70, respectively. Specifically, the positioning hole 90*f* is formed as a through hole in the drive plate 27 of the driving side scroll member 90. The positioning hole 70*f* is formed as a bottomed hole in the back surface of the first driven side end plate 71*a* (the surface opposite to the first driven side wall body 71*b*) of the driven side scroll member 70. The positioning holes 90*f*, 70*f* are formed to coincide at a predetermined rotation angle position. In the housing 3, an insertion hole 3*f* is formed as a through hole at a position corresponding to the positioning holes 90*f*, 70*f*, i.e., a position where the hole has a common axis with the positioning holes 90*f*, 70*f*. In the embodiment shown in FIG. 1, the insertion hole 3*f* is defined by a partition wall 3*g* that partitions a space into a motor storage space in which the motor 5 is stored and a scroll storage space in which the scroll members 70, 90 are stored.

Figure 7:
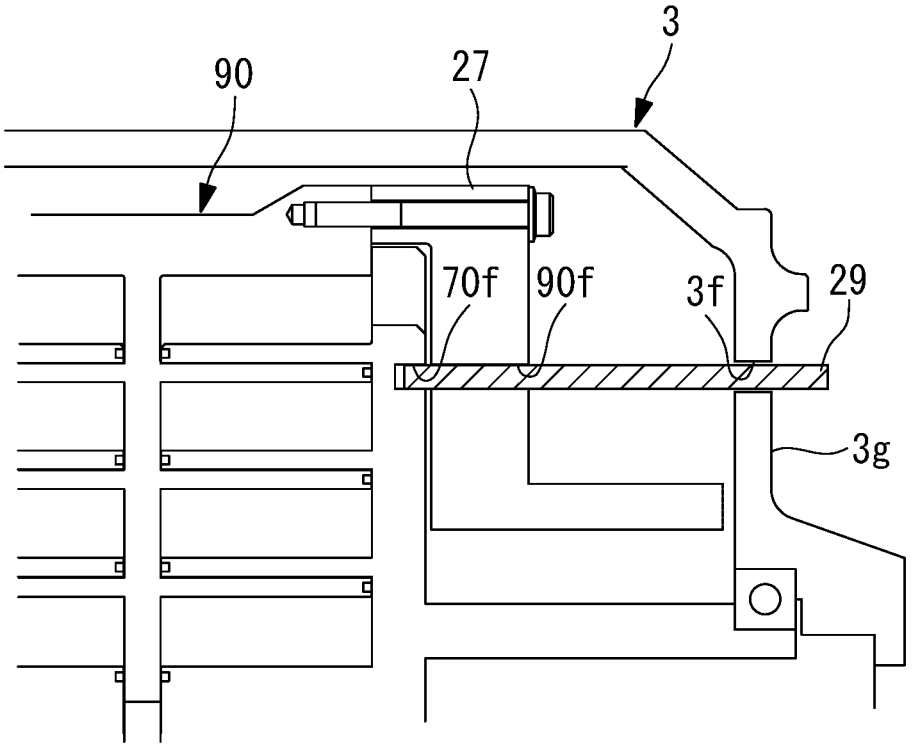
FIG. 7 is a partially enlarged longitudinal cross-sectional view showing a state where a positioning pin is inserted.
Figure 8:
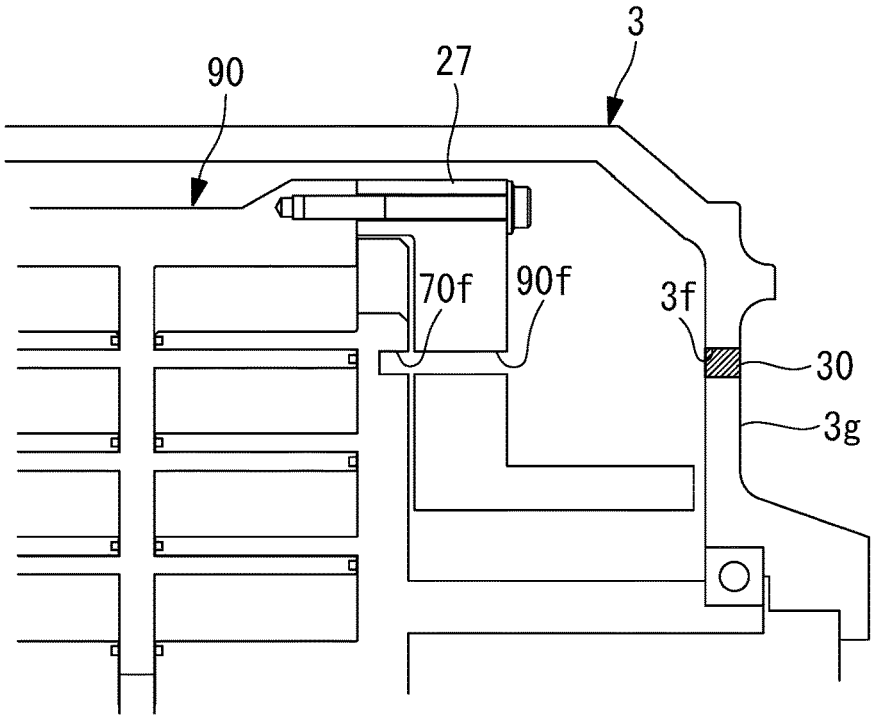
FIG. 8 is a partially enlarged longitudinal cross-sectional view showing a state where a sealing member is provided.

As shown in FIG. 7, a common positioning pin 29 is inserted from the motor storage space through the insertion hole 3*f*, and a tip of the positioning pin 29 is inserted in the positioning holes 90*f*, 70*f*, to position the driven side scroll member 70 and the driving side scroll member 90 in the rotation direction. The positioning pin 29 is for use only during the assembly, and is removed after relative positions of the driven side scroll member 70 and the driving side scroll member 90 are determined. Afterward, the insertion hole 3*f* formed in the housing 3 may be left as it is, or as shown in FIG. 8, a sealing member 30 may be attached to close the insertion hole 3*f*.

The co-rotating scroll compressor 1 including the above configuration operates as follows.

When the drive shaft 6 is rotated about the driving side rotation axis CL1 by the motor 5, the driving side scroll member 90 is rotated about the driving side rotation axis CL1 via the drive plate 27 connected to the front end of the drive shaft 6. Furthermore, the first flexible coupling 21 rotates about the driving side rotation axis CL1 via the coupling storage shaft 19 connected to the rear end of the drive shaft 6. The rotational driving force transmitted to the first flexible coupling 21 is transmitted to the second flexible coupling 22 via the driven shaft 20. The rotational driving force transmitted to the second flexible coupling 22 is transmitted to the driven side scroll member 70, and the driven side scroll member 70 is rotated about the second driven side rotation axis CL2. Thus, both the scroll members 70, 90 relatively perform revolution revolving movement.

When both the scroll members 70, 90 perform the revolution revolving movement, air taken inside through the air intake port of the housing 3 is taken inside from an outer peripheral side of both the scroll members 70, 90, and taken into a compression chamber formed by both the scroll members 70, 90. Then, a compression chamber formed by the first driven side wall body 71*b* and the first driving side wall body 91*b* and a compression chamber formed by the second driven side wall body 72*b* and the second driving side wall body 92*b* are separately compressed. A volume of each of the compression chambers decreases as being toward a center side, and the air is accordingly compressed. The air compressed by the first driven side wall body 71*b* and the first driving side wall foody 91*b* passes through the through hole 90*h* formed in the driving side end plate 90*a*, and joins air compressed by the second driven side wall body 72*b* and the second driving side wall body 92*b*. The joined air passes through the discharge port 72*d*, and is discharged outward from the discharge port 3*d* of the housing 3.

According to the present embodiment, following operations and effects are produced.

The driven shaft 20 has the rear end connected to the drive shaft 6 via the first flexible coupling 21, and has the front end connected to the driven side scroll member 70 via the second flexible coupling 22. Consequently, the rotational driving force from the drive shaft 6 is transmitted to the driven side scroll member 70 via the driven shaft 20. The driven shaft 20 connects the drive shaft 6 to the driven side scroll member 70 via the first flexible coupling 21 and the second flexible coupling 22. Therefore, the rotation of the drive shaft 6 rotating about the driving side rotation axis CL1 can be transmitted to the driven side scroll member 70 that rotates about the driven side rotation axis CL2 parallel to the driving side rotation axis CL1.

Thus, the use of the drive shaft 6, the first flexible coupling 21 and the second flexible coupling 22 enables the rotational driving force of the drive shaft 6 to be transmitted to the driven side scroll member 70 without using any bearings that require a lubricant. Consequently, it is not necessary to use any lubricants in the synchronous drive mechanism that transmits the rotational driving force to the driven side scroll member 70, and it is possible to prevent contamination of the compressed air.

Furthermore, in the synchronous drive mechanism that transmits the rotational driving force to the driven side scroll member 70, use of a mechanism such as a rolling bearing having a life determined by friction is avoided, and the driven shaft 20 and the flexible couplings 21, 22 are used, so that an infinite life design determined by a fatigue life of a leaf spring, rubber or the like of each of the flexible couplings 21, 22 is possible.

Additionally, in place of a configuration where the drive shaft 6 and the driven shaft 20 are arranged in an axial direction and connected in series, the driven shaft 20 is disposed in the hollowed drive shaft 6, and hence an axial length can be decreased as much as possible.

The first flexible coupling 21 that connects the driven shaft 20 to the drive shaft 6 is disposed on an opposite side of the drive shaft 6 as seen from the driving side scroll member 90 (a right side of the drive shaft 6 in FIG. 1), and the second flexible coupling 22 that connects the driven side scroll member 70 to the driven shaft 20 is disposed on a driving side scroll member 90 side of the drive shaft 6 (a left side of the drive shaft 6 in FIG. 1). Thus, the driven shaft 20 is disposed entirely over a longitudinal direction of the drive shaft 6 inside the drive shaft 6. Consequently, a deflection angle in each of the flexible couplings 21, 22 can be decreased as much as possible, and a life of each of the flexible couplings 21, 22 can be prolonged.

If the assembly is performed by using the first flexible coupling 21 and the second flexible coupling 22, there is concern that accuracy of phase alignment in the rotation direction of both the scroll members 70, 90 decreases. To solve the problem, the positioning holes 90*f*, 70*f* in which the common positioning pin 29 can be inserted are formed in the driving side scroll member 90 and the driven side scroll member 70. Thus, the positioning pin 29 is inserted in the positioning holes 90*f*, 70*f* during the assembly, so that the phase alignment in the rotation direction can be accurately determined.

The insertion hole 3*f* in which the common positioning pin 29 (see FIG. 7) can be inserted is provided in the housing 3, and the positioning pin 29 is inserted from outside the housing 3, so that the driving side scroll member 90 and the driven side scroll member 70 can be positioned.

The insertion hole 3*f* formed in the housing 3 is sealed with the sealing member 30 (see FIG. 8), so that the contamination of the compressed air can be prevented.

Note that in case where the insertion hole 3*f* is opened in the motor storage space in which the motor 5 is stored as shown in FIG. 1, the sealing member 30 does not have to be provided. Consequently, pressure in the motor storage space and pressure in the scroll storage space in which the scroll members 70, 90 are stored are equalized, and it can be avoided that the lubricant of the bearing that supports the rotation of the scroll members 70, 90 leaks to a compression medium side.

Figure 9:
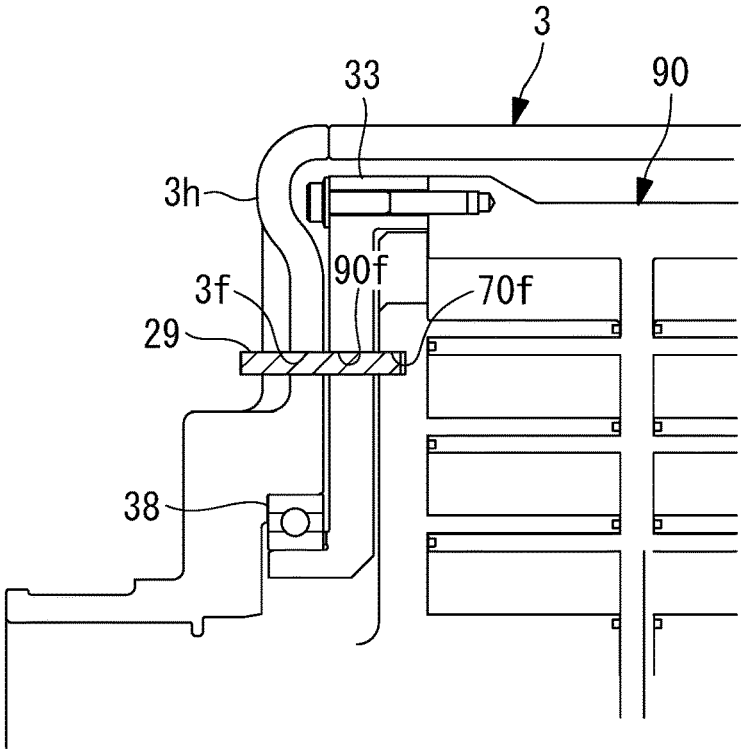
FIG. 9 is a partially enlarged longitudinal cross-sectional view showing a modification of an insertion position of the positioning pin.

Note that positions of the positioning holes 90*f*, 70*f* and the insertion hole 3*f* are not limited to positions shown in FIG. 1. For example, as shown in FIG. 9, in a front wall (a left wall part in the drawing) 3*h* of a housing 3, positioning holes 90*f*, 70*f* and an insertion hole 3*f* are formed, and a common positioning pin 29 may be inserted in the holes. In this case, when the positioning pin 29 is removed, a scroll storage space communicates with an exterior of the housing 3, and hence it is preferable to provide such a sealing member 30 as shown in FIG. 8.

REFERENCE SIGNS LIST

1 co-rotating scroll compressor
3 housing
3*a* motor storage section
3*b* scroll storage section
3*d* discharge port
3*f* insertion hole
3*g* partition wall
3*h* front wall
5 motor (a drive unit)
5*a* stator
5*b* rotor
6 drive shaft
11 driving side bearing
12 first driven side bearing
15 coupling storage shaft
17 rear end bearing
20 driven shaft
21 first flexible coupling
22 second flexible coupling
27 drive plate
27*a* drive plate shaft
27*b* insertion hole
28 bolt
29 positioning pin
30 sealing member
31 bolt
33 support member
70 driven side scroll member
70*f* positioning hole
71 first driven side scroll
71*a* first driven side end plate
71*b* first driven side wall body
71*d* first driven side scroll shaft
71*e* split shaft
72 second driven side scroll
72*a* second driver, side end plate
72*b*second driven side wall body
72*c* second driven side scroll shaft
72*d* discharge port
73 flange part
90 driving side scroll member
90*a* driving side end plate
90*f* positioning hole
90*h* through hole
91*b* first driving side wall body
92*b* second driving side wall body
CL1 driving side rotation axis
CL2 driven side rotation axis

The invention claimed is:

1. A co-rotating scroll compressor comprising:

a driving side scroll member that is driven by a drive unit to rotate about a driving side rotation axis, and includes a spiral driving side wall body disposed on a driving side end plate, a driven side scroll member that is driven to rotate about a driven side rotation axis parallel to the driving side rotation axis, performs rotation movement at the same angular velocity in the same direction as in the driving side scroll member, and includes a spiral driven side wall body corresponding to the driving side wall body and disposed on a driven side end plate, the driven side wall body being caused to mesh with the driving side wall body to form a compression space, a hollowed drive shaft that is connected to the driving side scroll member, and driven by the drive unit to rotate, and a driven shaft that is disposed inside the drive shaft, and has one end connected to the drive shaft via a first flexible coupling and the other end connected to the driven side scroll member via a second flexible coupling.

2. The co-rotating scroll compressor according to claim 1, wherein the first flexible coupling is disposed on an opposite side of the drive shaft as seen from the driving side scroll member, and the second flexible coupling is disposed on a driving side scroll member side of the drive shaft.

3. The co-rotating scroll compressor according to claim 1, wherein positioning holes in which a common positioning pin is to be inserted are formed in the driving side scroll member and the driven side scroll member.

4. The co-rotating scroll compressor according to claim 3, further comprising:

a housing that houses the driving side scroll member and the driven side scroll member, wherein an insertion hole in which the common positioning pin is to be inserted is formed in the housing.

5. The co-rotating scroll compressor according to claim 4, further comprising:

a sealing member with which the insertion hole is sealed.

6. An assembly method for a co-rotating scroll compressor comprising:

a driving side scroll member that is driven by a drive unit to rotate about a driving side rotation axis, and includes a spiral driving side wall body disposed on a driving side end plate, a driven side scroll member that is driven to rotate about a driven side rotation axis parallel to the driving side rotation axis, performs rotation movement at the same angular velocity in the same direction as in the driving side scroll member, and includes a spiral driven side wall body corresponding to the driving side wall body and disposed on a driven side end plate, the driven side wall body being caused to mesh with the driving side wall body to form a compression space, a hollowed drive shaft that is connected to the driving side scroll member, and driven by the drive unit to rotate, and a driven shaft that is disposed inside the drive shaft, and has one end fixed to the drive shaft via a first flexible coupling and the other end connected to the driven side scroll member via a second flexible coupling, wherein positioning holes in which a common positioning pin is to be inserted are formed in the driving side scroll member and the driven side scroll member, the assembly method for the co-rotating scroll compressor, comprising:

a step of inserting the common positioning pin in the positioning holes to position the driving side scroll member and the driven side scroll member, and then removing the common positioning pin.

* * * * *